US005417016A

United States Patent [19]

Dahowski et al.

[11] Patent Number: 5,417,016

[45] Date of Patent: May 23, 1995

[54] COVER FOR OPENINGS CONTIGUOUS TO A SWIMMING POOL

[75] Inventors: Donald E. Dahowski; Paul D. Spies, both of York, Pa.

[73] Assignee: Quaker Plastic Corporation, Mountville, Pa.

[21] Appl. No.: 106,827

[22] Filed: Aug. 16, 1993

[51] Int. Cl.[6] ..... E04B 7/00

[52] U.S. Cl. ..... 52/23; 52/186; 4/496

[58] Field of Search ..... 52/23, 198, 199, 184, 52/186, 19; 4/488, 496, 498, 503, 506, 504

[56] References Cited

U.S. PATENT DOCUMENTS

| | | | |
|---|---|---|---|
| 3,236,012 | 2/1966 | Laven | 4/506 |
| 3,564,792 | 2/1971 | Sanford | 52/187 |
| 3,596,295 | 8/1971 | Wilson | 4/172.15 |
| 3,755,981 | 9/1973 | West | 4/506 |
| 3,763,503 | 10/1973 | Volkle | 4/172 |
| 3,774,364 | 11/1973 | Johnson | 52/23 |
| 3,859,673 | 1/1975 | Meyerhoff, Sr. | 4/488 |
| 4,001,899 | 1/1977 | Mathis | 4/172 |
| 4,170,047 | 10/1979 | Corsette et al. | 4/488 |
| 4,238,659 | 12/1980 | Koshiga et al. | 219/61 |
| 4,371,003 | 1/1982 | Tega | 59/16 |
| 4,658,449 | 4/1987 | Martin | 4/49 C |
| 4,658,555 | 4/1987 | Steiner | 52/202 |
| 4,661,247 | 4/1987 | Weir et al. | 210/97 |
| 4,797,957 | 1/1989 | Weir et al | 4/506 |
| 4,991,691 | 2/1991 | Brawer et al. | 182/106 |
| 5,086,525 | 2/1992 | Christopher | 4/498 |
| 5,131,102 | 7/1992 | Salley et al. | 4/498 |
| 5,228,148 | 7/1993 | Weir | 4/496 |
| 5,282,339 | 2/1994 | Devlin et al. | 52/186 |

*Primary Examiner*—Carl D. Friedman
*Assistant Examiner*—Kien T. Nguyen
*Attorney, Agent, or Firm*—Arthur J. Plantamura

[57] ABSTRACT

A cover devised to be positioned over and to overlay an opening contiguous to a swimming pool such as a stairwell opening. The cover is a preformed modular plastic unit. The cover may comprise a single molded piece or a plurality of pre-molded sections that are secured side-by-side to form a rigid unit. The cover is preferably slightly domed and provided with integrally formed strengthening ribs or channels. The dome shape facilitates flowing of water which may accumulate on the cover surface, to the rear and to the sides of the cover. Suitable means, such as pliable plastic water filled tubes, or other hold down means, function to retain the cover in place when in position, against undesirable dislocation from its covering position. The cover also facilitates the installation of a flexible vinyl liner in a swimming pool by providing means to hold the liner over, and to seal, the opening during the installation of the liner.

16 Claims, 3 Drawing Sheets

COVER FOR OPENINGS CONTIGUOUS TO A SWIMMING POOL

The invention relates to a cover for openings that are contiguous to a swimming pool. Openings of this kind include, especially stairwells, but also relate to other openings, such as swim-out areas, spas, seating facilities, and the like, that are contiguous to a swimming pool. The cover will be described primarily with reference to swimming pool stairwells, it being understood, however, that the cover with appropriate modification may be applied also to such other openings that are formed contiguous to and generally open into the main swimming pool. The cover of the invention is adaptable for use with openings, e.g., stairwells of various widths, and is readily adaptable for virtually all pools with such openings including new as well as pre-existing swimming pools. More particularly, the cover of the invention, which is provided in modular parts that are assembled into a single cover unit, or is molded as complete modular unit, is devised for positioning over a stairwell or other opening which extends from the swimming pool and is secured in place by suitable means. The cover is preferably provided at the front edge, which faces into the swimming pool, with a dependent ledge which carries a dual receiver bead that aligns with a bead receiver which is generally positioned below the coping on the inside perimeter of a swimming pool. The invention may be used in any of a wide variety of swimming pool stairwells including use in those swimming pools formed from a plurality of contiguously joined modular wall panels. The cover of the invention is preferably formed with a slightly dome-shaped configuration and is constructed from a substantially rigid and tough, though not brittle, plastic composition and is provided with integrally formed strengthening ribs and integrally formed, i.e., molded, channels to effectively drain water which may accumulate on the surface of the cover.

BACKGROUND OF THE INVENTION

In preparing a in-ground swimming pool for off season "storage", sometimes referred to as "winterizing" the pool, especially in relatively cooler climates, a cover is usually used over the body of water in the pool. This winterizing of the swimming pool is desirable for a variety of reasons, including but not limited to: the prevention of accumulation in the pool of debris, such as leaves and other materials; the prevention of unnecessary evaporation of the pool water; as a safeguard to prevent the falling into the unattended pool of a young child or other person or animal; and generally to protect the swimming pool against the elements. In those swimming pools that employ a stairway that comprises a plurality of steps or a ramp-like swim-out area leading from the pool deck into the shallow end of the pool, as distinguished from those swimming pools that use only a removable ladder for ingress and egress from the pool, the stairway opening must also be covered when winterizing the pool. In the past, the usual practice has been to place a sheet of plywood over the stairwell or other opening and attempt to improvise some arrangement for holding the plywood in place and for securing the pool cover to the edge of the plywood closest to the pool interior or to try to use a larger than necessary cover which extends not only over the swimming pool area but also over the deck and other "contiguous" opening and then to hold the cover in place with weights such as logs, water tubes, sandbags, or other weights. This practice has been largely unsatisfactory; is unsafe, because a child or animal can fall through the well area; is relatively ineffective; and is unsightly. With respect to the use of a plywood sheet as a cover, the plywood weathers and splinters. Also, the connection of the pool cover draped over the pool with the cover positioned over the stairwell, to provide an overall integrated seal has been particularly difficult to accomplish and is prone to separation and substantial leakage between the two covers. For at least these reasons, a need exists for a conveniently adaptable stairwell cover or shield that is effective economical and practical such as that provided by the present invention.

SUMMARY OF THE INVENTION

The present invention provides a novel, cover for those openings contiguous to a swimming pool; the cover being being applied by positioning it horizontally over the opening. The basic form of the cover of the invention comprises a modular unit which is a slightly dome-shaped molded unit having a configuration which extends across and slopes downward and covers the opening such as that of a stairwell. The cover unit is provided with integrally molded ribs for added rigidity and resistance to sagging and with integrally molded channels to direct the flow of water, that accumulates on the cover, to the sides and back away from the interior of the swimming pool. The form and design of the cover unit of the invention is so constructed and arranged that its use with the swimming pool structure involves essentially only the positioning of the cover over the opening that is contiguous to the pool and securing it in place by suitable means such as with water-filled plastic tubes that are positioned in the channels formed on the cover, or by suitably securing the cover with other suitable means such as a strap positioned over the cover and anchoring the strap at its ends with pins fastened on the swimming pool deck. The cover unit of the invention is light in weight, strong and durable, and affords a convenient, highly desirable accessory for swimming pool maintenance.

The modular cover unit of the invention may comprise a single section or a plurality of sections joined side-by-side and is preferably provided with a bead receiving channel at its front edge to assist in holding a swimming pool cover. The bead receiving channel on the front edge of the cover is preferably a dual reversible bead receiver that cooperates with the conventional bead receiving channel that is formed below the coping of the swimming pool to thereby provide a substantially uninterrupted gripping means for the pool cover around the entire periphery of the swimming pool. The bead receiver is preferably a dual reversible bead receiver which accepts a conventional bead that is lock in the bead receiving channel by a bottom projection contained on the receiver or, in the case of a "reverse" bead (which is supplied by some manufacturers), looked in place by an upper projection contained at the top of the bead receiving channel.

It is accordingly an object of the invention to provide swimming pool stairwell cover which is readily positioned horizontally and held in place over the stairwell opening.

It is another object of the invention to provide a swimming pool stairwell cover which comprises a slightly domed molded unit which allows water which may accumulate on the surface of the cover to flow from the cover to the sides and rearward away from the pool interior.

A further object of the invention is to provide a molded plastic swimming pool stairwell cover which contains integrally formed strengthening ribs and/or channels or indentations that provide convenient locations for hold-down weights.

It is another object of this invention to provide a swimming pool stairwell modular cover that is equipped with a bead receiving channel, preferably a dual bead receiver, to hold the bead of a swimming pool cover.

It is a further object of the invention to provide a swimming pool stairwell cover that is provided with a depending front ledge which extend to a depth that conforms with the swimming pool coping and is devised to hold a bead receiving channel at a level substantially the same as the bead receiving channel provided below the coping of a swimming pool and to restrict side-to-side movement of the cover when the cover is positioned in place over the opening, such as a stairwell, that is contiguous to the pool.

Another object of the invention is to provide a modular cover capable of performing an an important function in the installation of a swimming pool liner, or the replacement of a liner with a new liner. The cover which is preferably provided at the front edge which faces into the pool with a dependent leg ledge which carries a bead receiver. This bead receiver aligns with the bead receiver carried by the coping on the inside perimeter of the swimming pool. By continuing the cover bead across the front edge of the cover of the invention (locked in the bead thereof) the open stairwell or other opening is sealed off thereby allowing an uninterrupted liner bead perimeter permitting a vacuum to be applied to set the liner in place.

A further and preferred object of the invention resides in the provision of a modular molded stairwell cover which comprises a composite of modular parts that are devised to be joined side-by-side to accommodate a variety of stairwell size openings.

Another object of the invention is to provide a joint between the assembled parts of a cover the affords a seal against seepage between the modular parts that comprise an assembled cover unit.

Additional objects, advantages and capabilities afforded by the invention will become apparent from the accompanying drawing and the detailed description which follow:

DETAILED DESCRIPTION OF THE INVENTION

Figure 1:
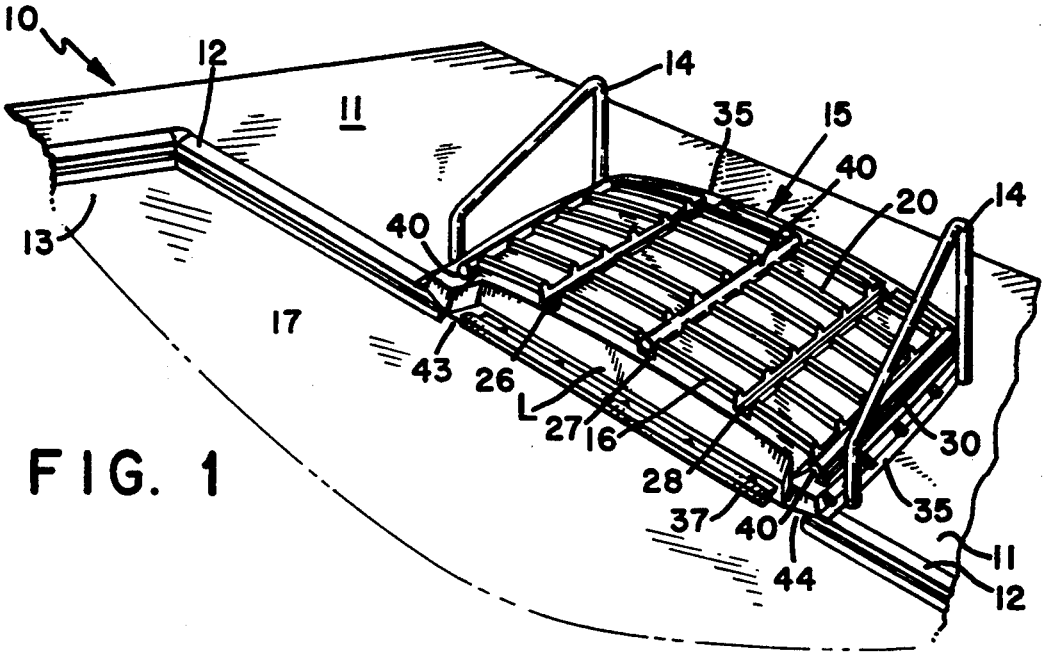
FIG. 1 is a perspective view of one form of a cover according to the invention in which the cover is illustrated on a stairwell and in conjunction with a segment of a perimeter wall and deck of a the swimming pool.

The swimming pool stairwell cover of the invention, in its preferred embodiment, contemplates the provision of the preformed plastic module devised to be positioned over and secured in place horizontally over the open stairwell. Suitable means are used to hold the cover in place over the stairwell against accidental movement by the elements, e.g., against storms, or by contact with persons or objects. The securing means may comprise weights placed on the stairwell cover or any convenient hold-down arrangement for the cover. One such weighting arrangement utilizes pliable plastic tubes having a diameter of about 6 inches and a length of 3 to 4 feet which when filled with water provide a suitable ballast. A plurality of these water filled tubes approximately fitted in spaced indentations on the cover are very effective in holding the cover in place. Alternatively, other suitable hold down means for retaining the cover in place may be used. Preferably such hold down means should not entail a significant modification of the cover or of the surrounding pool structure. One means may comprise a spring loaded strap which is passed over the stairwell cover when in the horizontal position over the stairwell with the ends of the strap secured in a below deck fasteners or pins in the deck at either side of the stairwell or in the openings provided by the stair railings which are removed in the winterizing of the pool operation.

During the swimming season when the stairwell cover of the invention is not in use, the cover which is light in weight, may be conveniently stored by hanging it up vertically on a hook against either an inside or outside wall of a building such as by a rope secured on an interior portion of the underside of the cover. The outer surface may be provided with an aesthetically designed surface or overlay for a more pleasing appearance when the cover is hung at a place exposed to view.

The cover of the invention is adaptable to a wide variety of swimming pools which are provided with walk-in type stairs, swim-out ramps, spas, seating accommodations and other openings contiguous to the swimming pool, including one piece gunnite type pools and those pools that are fabricated from a plurality of contiguously joined, vertically disposed wall panels and employ a pre-molded one-piece stair module fitted between vertical wall panels. Typical swimming pools of the latter construction are those disclosed for example in U.S. Pat. Nos. 3,596,295; 4,661,247; and 4,797,957. Generally, pools of this kind include a flexible water impermeable vinyl liner which covers the walls (that are formed of the contiguously secured modular wall panels) and the bottom of the swimming pool to define a water holding container. The modular cover of the invention is devised to be positioned over the stairwell of such pools and may be provided with a depending front ledge which fits in the stairwell at the pool coping level and restricts side to side movement of the cover when it is fitted over the stairwell opening.

The cover of the invention is adaptable to be placed over any opening contiguous to a swimming pool. In addition to stairwells, such opening may include: swim-out ramps; spas of the kind illustrated, for example, in U.S. Pat. Nos. 4,001,899, 4,238,859 and 4,371,003; seating accommodations such as that shown in U.S. Pat. No. 5,228,148, and the like.

The advantages of the modular preformed plastic cover of the invention include:

- an aesthetically attractive and durable overlay for a swimming pool opening;
- a relatively inexpensive, strong, light weight unit which when in place over a swimming pool stairwell or other opening will withstand the elements and the weight of a person without damage to the cover; and
- a convenient, easy to use and to store, important accessory for effective swimming pool maintenance.

Referring now to the drawing, and more particularly to FIG. 1, a segment 10 of a swimming pool stairwell with the cover module of the invention 15 in place on the stairwell is shown. The fragment of the swimming pool 10 of FIG. 1 comprises portions of the vertical perimeter wall 13, a deck portion 11 and a coping element 12 which forms the transitional piece at the corner of the vertical wall and the horizontal deck of a conventional swimming pool.

The modular cover of the invention which is constructed so as to facilitate its positioning over the opening contiguous to a swimming pool comprises a slightly domed configuration which prevents accumulation of water on the cover surface and directs the flow of any such accumulated water to the sides and to the back of the cover away from the swimming pool interior 17. The positioning in place and securing of the cover of the invention over the opening requires no modification of the wall or of the opening or, in the case of stairwells, without modifying the stairs or the stairwell, the pool deck, or other part of the swimming pool construction.

Figure 2:
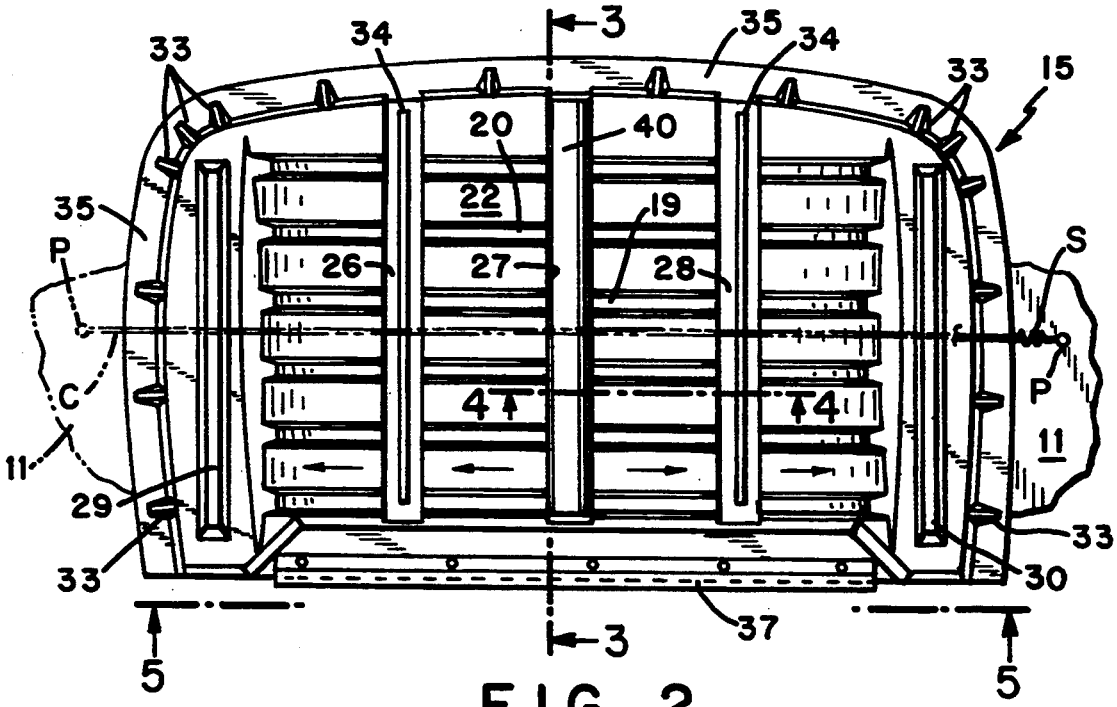
FIG. 2 is a top plan view of the modular cover of the invention which is shown in FIGS. 1.
Figure 4:
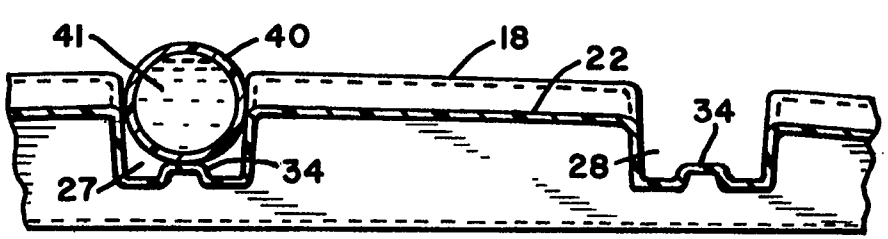
FIG. 4 is a sectional view taken along line 4—4 of FIG. 2 illustrating also the position of a water filled plastic tube for weighting down the cover that is positioned in a channel formed in the cover
Figure 5:
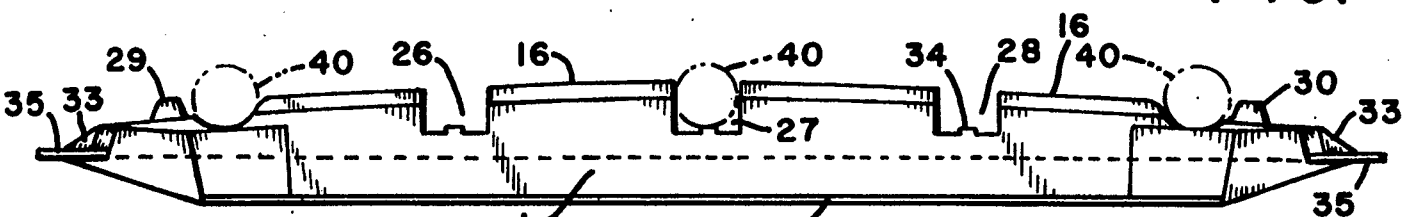
FIG. 5 is a front elevational taken along line 5—5 of FIG. 2 and also illustrating, in phantom, water tubes—that weight down and hold the cover—in position on the cover for the purple of substantially immobilizing the cover.

As seen in FIG. 1, the cover 15 incorporates a suitable number of integrally formed embossed indentations or ribs, six of which are shown 16, 17, 18, 19, 20 and 21 which provide significant improved rigidity compared to a smooth, i.e., uninterrupted flat, surface. Because of the slight dome shape of the cover—the center of the cover at the highest elevation when the cover is in place—the space between these ribs is also effective in directing flow of water accumulating on the cover surface from the center of the cover to the sides as indicated by the arrows shown between the ribs 19 and. 20 of FIG. 2. The cover is also preferably formed so as to have one or more integrally formed drain channels disposed essentially transversely to the integrally formed ribs, three such drain channels, 26, 27, and 28 of which are illustrated in FIG. 2. These channels also impart improved rigidity or stiffening to the cover and serve as drain channels and may serve as positions where flexible plastic tubes 40 filled with water 41 can be placed for the purpose of substantially immobilizing the cover after it is in position over the stairwell. See FIG. 4. Also shown in FIG. 4 are the channels 26, 27, and 28 which are preferably provided with a central rise 34 at the bottom of the channel which allows water to flow even when the water filled tubes 40 are positioned in the channels. These central rise portions 34 also function to prevent water seepage and enhance overall rigidity of the cover as noted more particularly by reference to FIG. 6A. Additionally, the cover may optionally be provided with suitably located, integrally formed, end ribs two of which 29 and 30 are illustrated in FIG. 2. Suitable alternative means for substantially immobilizing the cover in addition to the water filled tubes may be employed. As illustrated schematically in FIG. 2, a strap or cord C which preferably incorporates a spring Segment S is stretched across the top of the cover 15 and is appropriately anchored as by means of pins P in the pool deck on each side of the cover 15. The front of the cover of the invention which substantially aligns with the coping of the swimming pool, is preferably provided with a depending ledge portion L which extends below the swimming pool deck level when the cover is in place and restricts side-to-side movement. Side-to-side movement of the cover in place is restricted because the depending portion L of the cover abuts the coping contiguous to the sides 43 and 44 of the stairwell wall at the entry to the pool. See FIG. 1.

Figure 3:
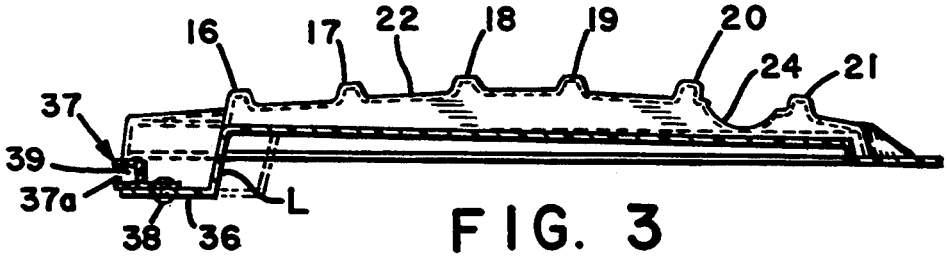
FIG. 3 is a sectional view taken along line 3—3 of FIG. 2.
Figure 3A:
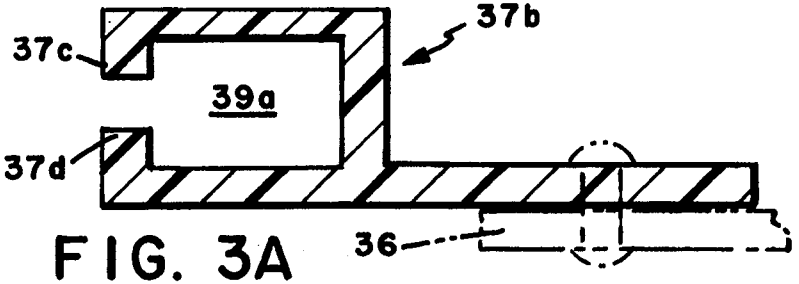
FIG. 3A is an enlarged cross sectional elevational view of a dual bead receiver, which accommodates a conventional, as well as a reverse type bead.

The front of the cover is may be provided with a cover bead holding channel segment or bead receiver 37 secured at 38 near the bottom 36 of the ledge L. See FIG. 3 and preferably with a dual reversible bead receiver. As shown in FIG. 3A, the bead receiver segment 37 functions in cooperation with a conventional bead holding channel or receiver positioned below the swimming pool coping to hold a swimming pool cover that is placed over and covers the entire surface of the swimming pool. The bead receiver segment 37 shown in FIG. 3 retains the peripheral bead of that segment of the flexible plastic swimming pool cover (not shown) which extends in front of the stairwell, within the channel opening 39 or 39*a* for FIG. 3A. When a dual bead receiver 37*b* such as that shown in FIG. 3A is inserted at 39*a*, the receiver is adaptable with either a standard bead(formed on the bottom of the liner) locked in by the extension 37*d*, or a less conventional bead (formed at the top) as supplied by some liner manufacturers, which is locked in by the extension 37*c*.

The front of the cover of the invention is also provided with a depending bottom edge flange 35 which extends continuously around the left side, the back, and the right side of the cover 15. to lend greater strength and to inhibit distortion and so that the the this edge flange 35 maintains a flat abutment against the deck, the flange 35 is provided with suitably spaced integrally formed gussets 33 which inhibit upward "curl" of the flange portion 35.

Figure 6:
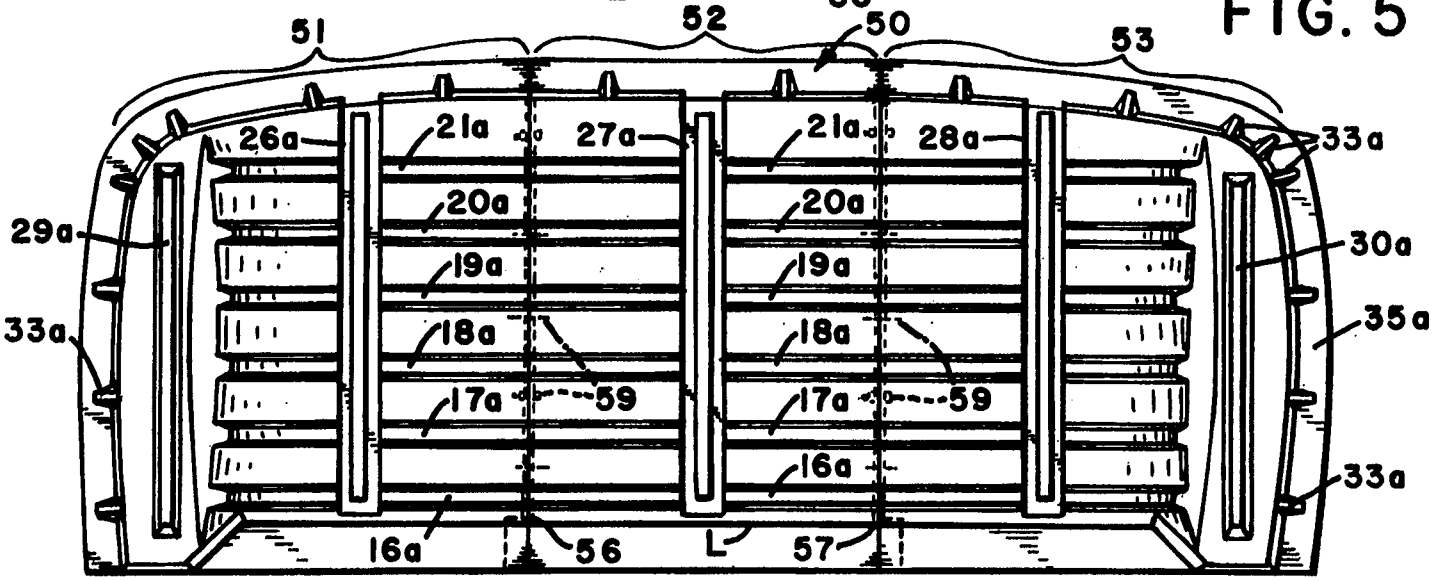
FIG. 6 is a top plan view of an alternative embodiment in which the modular cover is formed of three sections to form the cover in accordance with the invention.
Figure 8:
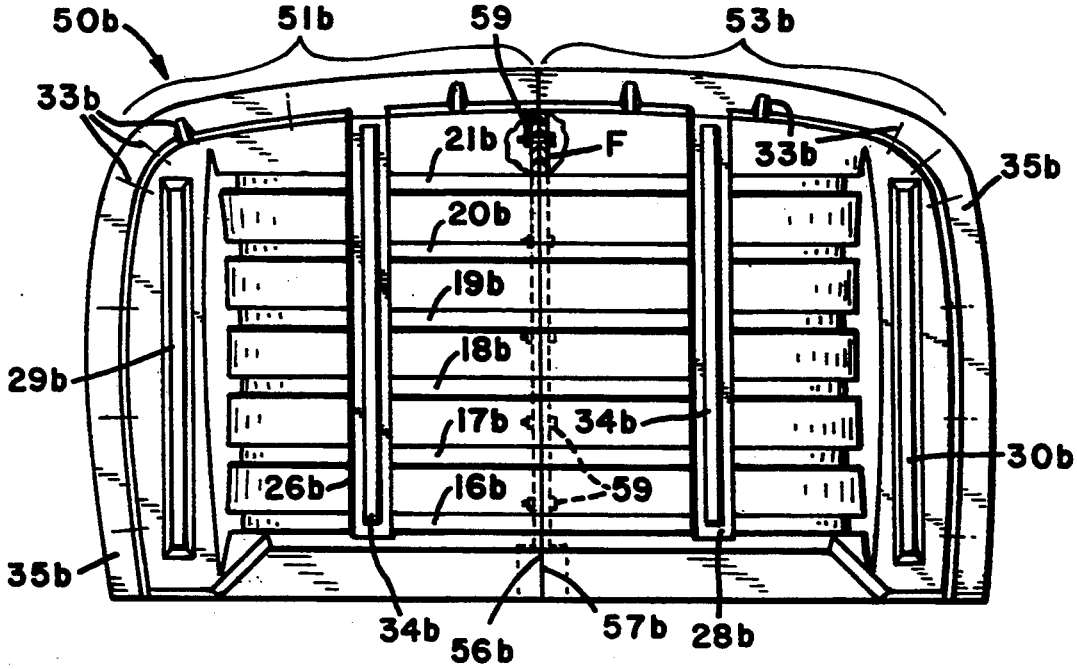
FIG. 8 is a top view of another relatively smaller cover unit formed from two of the three modular segments of the unit illustrated in FIG. 6.

In the alternative embodiments illustrated in FIGS. 6, 6A, 7 and 8, the cover of the invention comprises premolded modular plastic sections which are suitably joined side by side to provide a unitary cover of a size adequate to fit the an opening to be covered. For example, in the case of pool stairwells, many pool stairwells are either approximately 6 feet wide or approximately 8 feet wide. The covers of FIGS. 6 and 8 illustrate that the same modular segments may be used to provide a cover for either a smaller (stairwell) opening -using two modular segments, 51 and 56-or larger (stairwell) opening which includes also the center modular segment 52. It will be apparent to one skilled in the art, however, that the invention may be applied to a variety of differing width openings, other than stairwells, by appropriately sizing and joining the appropriate modular sections when the openings are relatively large or by a one-piece molded cover.

In referring to the elements forming the covers of FIGS. 6 and 8, those elements having the same function as those referenced in FIGS. 1–5, will also be referred to by the same reference numerals with the proviso that these numerals are accompanied by the letter "a" for the elements of FIG. 6 and by the letter "b" when referring to the like elements in FIG. 8. Similarly, references employed in FIG. 8 and not appearing in FIGS. 1–5 function similarly as those with similar reference numbers as l the elements of FIG. 6 with the proviso that those elements of FIG. 8 bearing the same reference numerals are accompanied by a letter "b".

As seen by reference to FIG. 6, the stairwell cover of the invention comprises three parts or sections: a left section 51, a center section 52 and a right section 53, suitably joined through respective integrally formed flanges at 56 and 57 to form a substantially rigid unit which is adaptable to fit over a swimming pool opening, such as a stairwell . The sections 51, 52, and 53, also sometimes referred to as "segments", are pre-molded with a depending edge flange having a face F (see FIG. 7) of sufficient thickness and width, and of adequate strength, such that when suitably joined, such as with fasteners, which may include washers, and bolts 59, through preformed openings in the flanges, an overall rigid construction is produced.

Figure 6A:
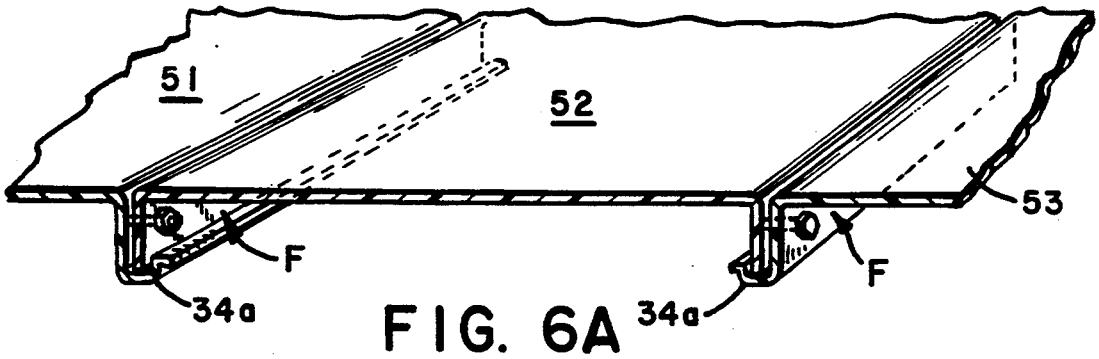
FIG. 6A is a fragmentary schematic view showing an arrangement for joining an inner modular section so as to better preclude seepage of surface water at the joint of the cover parts and which, by interfitting the parts, also lends increased strength and rigidity, to the assembled unit.
Figure 7:
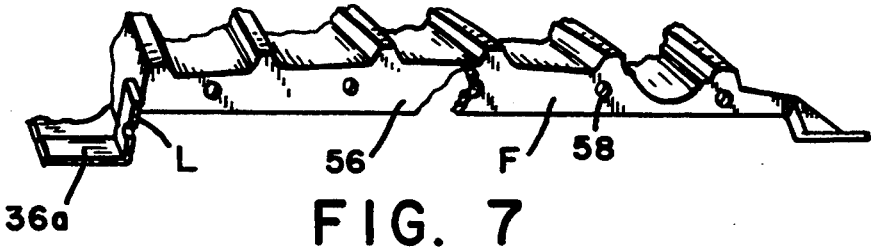
FIG. 7 is an elevational view of a joined edge portion of a modular section of the multi-segment unit of the kind shown in FIG. 6.

In FIG. 6A an arrangement is illustrated wherein a plurality of sections, which when joined together is substantially effective in precluding the entry into the swimming pool of surface water through the cover. The modular center section 52 is provided with depending sides that fit within the channel 57 between the side of the channel and the central rise 34 at the bottom of the channel. This fit, when the segments are joined and fastened together, is effective to substantially enhance the overall stiffness of the assembled cover.

It is seen by reference to the cover of FIG. 8 that it comprises the left section **51*b* and the right section 53*b* which are respectively the same as sections 51 and 53 of FIG. 6. Thus, by omitting the central section 52 of the cover 50 of FIG. 6 which is assembled to cover an 8 foot stairwell opening, a cover 50*b* is provided as shown in FIG. 8 that is suitable for covering a relatively narrower, i.e., a 6 foot wide stairwell opening. Suitable calking, such as a fibrous or rubberized composition, or any other suitable filler, may be applied at the joint between the segments when the segments are fastened together to fill any space which may be present between the joined segments, to improve the seal, and to enhance the appearance. It will be apparent that by providing the central segment 52** in a variety of widths, a wide range of cover sizes, in addition to the above referred 6 and 8 foot widths, may be constructed.

As disclosed when describing the embodiment of FIGS. 1–5, the covers of FIG. 6 and FIG. 8 are also preferably equipped with a depending leg portion at the front of the cover which restricts side to side movement and on which a cover bead receiving channel (not shown) is secured for holding a cover bead.

An important advantage available by use of the cover of the invention resides in the use of the cover to install a flexible vinyl liner in a swimming pool. When installing the liner, use is made of the bead holding receiver segment on the cover of the invention to hold that part, of the liner that is positioned in the liner bead holding receiver located around the perimeter of the pool (below the coping), over the opening formed by the stairwell. By so doing an uninterrupted covering of the entire swimming pool cavity by the vinyl liner is possible. It is thereby possible to apply a vacuum to set the liner because the opening formed by the stairwell is sealed. Once the liner is set, a face plate ouch as that disclosed in pending U.S. Patent application Ser. No. 07/969,132 of D. E. Dahowski, filed on Oct. 30, 1992, is secured over the liner at the stairwell opening and the portion of the liner covering the stairwell opening is trimmed away. This procedure obviates the prior, relatively very cumbersome, methods of effecting the installation of a vinyl liner, or the replacement of a vinyl liner in a swimming pool.

Suitable alternative mean e for imparting rigidity and strength to the cover of the invention may be employed and for fitting the cover on a openings that are contiguous to the main swimming pool and to restrict the side-to-side movement or displacement of the cover when the cover is in place. Such modifications will be apparent to one skilled in the art and may be incorporated in the stairwell cover of the invention. Thus, while the invention is described in detail and shown in the accompanying drawings present preferred embodiments, it will be understood that the invention may be modified in various additional details without departing from the scope and spirit of the invention as presented by the claims which follow.

What is claimed:

1. A swimming pool stairwell cover comprising a molded plastic unit preformed to fit over an opening that is contiguous to a swimming pool, said cover having:

a. a plurality of stiffening/strengthening elements integrally molded in the cover;

b. means at the front edge of the cover adapted to secure the peripheral bead of a swimming pool cover or liner; and c. means to hold down the stairwell cover upon positioning of the cover over a stairwell.

2. The cover of claim 1 including means to restrict side-to-side movement when the cover is positioned over the opening contiguous to the swimming pool.

3. The cover of claim 1 comprising a slightly domed shape such that when the cover is in place contiguous to a swimming pool, water accumulating on the cover drains to the sides and to the rear away from the interior of a swimming pool.

4. The cover of claim 1 in combination with a swimming pool and wherein means are included on the cover to restrict side-to-side movement of the cover when the cover is located in position contiguous to the swimming pool comprising a depending ledge extending across the front of the cover and wherein the left and right ends of said depending ledge abut the left and right upper walls respectively of the opening contiguous to a swimming pool coping.

5. The cover of claim 4 in which the depending ledge is provided with a bead holding channel which functions to hold a portion of a bead formed around a periphery of a swimming pool cover that is placed over a swimming pool.

6. Thee cover of claim 1 wherein said strengthening/-stiffening elements comprise a plurality of ribs or channels that are integrally formed on the molded surface of the plastic cover .

7. The cover of claim 6 in combination with water filled plastic tubes which provide ballast positioned in said strengthening ribs or channel to retain the fitted cover in place.

8. The cover as in claim 1 further comprising plastic molded companion modular sections which are joined side by side to provide a unit having substantial rigidity.

9. The cover of claim 8 wherein said companion modular sections formed with a slightly domed configuration such that when the cover is in position and water accumulates on the cover, such water will drain to the rear and to the sides away from the interior of the swimming pool.

10. The cover of claim 8 wherein means restricting side to side movement comprising a depending ledge extending across the front of the cover and the left and right ends contact the left and right upper walls of a stairwell contiguous to a swimming pool coping.

11. The cover of claim 8 in which the depending ledge is provided with a bead holding channel to hold a portion of a bead that is formed on a periphery of a swimming pool cover that is placed over a swimming pool.

12. The cover of claim 8 wherein the strengthening elements comprise a plurality of strengthening ribs that are integrally formed in the molded surface of the respective sections.

13. The cover of claim 8 in combination with water filled plastic tubes which provide ballast to retain the cover when positioned over an opening contiguous to a swimming pool.

14. The cover in accordance with claim 8 comprising a left section, a center section, and a right section.

15. The cover as in claim 14 comprising solely the left section and the right section.

16. The cover as in claim 8 wherein the joined sections include a seal between the joined sections to preclude water accumulating on the cover from passing through the cover.

* * * * *